US005454774A

United States Patent [19]

Davis

[11] Patent Number: 5,454,774

[45] Date of Patent: Oct. 3, 1995

[54] GOAL ORIENTED LEARNING DEVICE

[76] Inventor: Ronald R. Davis, 131 Maynard Rd., Sequim, Wash.

[21] Appl. No.: 332,635

[22] Filed: Oct. 31, 1994

Related U.S. Application Data

[63] Continuation of Ser. No. 19,040, Feb. 18, 1993, abandoned.

[51] Int. Cl.[6] ..... A63B 22/00; A63B 22/16

[52] U.S. Cl. ..... 482/146; 482/909; 601/33; 434/258

[58] Field of Search ..... 482/44, 79, 146, 482/147, 909; 434/258, 260, 261; 601/33–35; 273/449

[56] References Cited

U.S. PATENT DOCUMENTS

| | | | |
|---|---|---|---|
| Re. 32,150 | 5/1986 | Rice | 482/146 |
| 2,256,001 | 9/1941 | Titus . | |
| 2,351,293 | 6/1944 | Saunders . | |
| 3,020,046 | 2/1962 | Hotas | 482/79 |
| 3,384,369 | 5/1968 | Rumell . | |
| 3,702,188 | 11/1972 | Phillips et al. | 482/146 |
| 3,713,653 | 1/1973 | Romans | 482/44 |
| 3,721,440 | 3/1973 | Burns . | |
| 3,929,462 | 12/1975 | Karmin | 434/258 |
| 4,199,137 | 4/1980 | Giguere | 482/79 |
| 4,306,714 | 12/1981 | Loomis et al. | 482/79 |
| 4,471,957 | 9/1984 | Engalitcheff, Jr. | 434/260 |
| 4,505,476 | 3/1985 | Rubin . | |
| 4,548,289 | 10/1985 | Mechling | 128/25 R |
| 5,092,586 | 3/1992 | Tuthill et al. | 482/146 |
| 5,112,045 | 5/1992 | Mason et al. . | |

FOREIGN PATENT DOCUMENTS

| | | | |
|---|---|---|---|
| 0859975 | 1/1971 | Canada | 434/258 |
| 2592802 | 7/1987 | France | 482/146 |
| 227571 | 10/1910 | Germany . | |
| 2420826 | 11/1975 | Germany . | |

*Primary Examiner*—Richard J. Apley
*Assistant Examiner*—Jeanne M. Clark
*Attorney, Agent, or Firm*—R. Reams Goodloe, Jr.

[57] ABSTRACT

A device and method for rehabilitation of patients with kinesthetic injuries. The device consists of a base with non-skid feet to securely locate the device on a supporting surface. An upwardly extending guide member is located on the base. A target attachment with target is attached to the guide member. A repositionable platform assembly with a downwardly extending platform support point is placed at a receiving location on the base. From the upper surface of the repositionable platform extends a wand support with a wand tip at its upper end. Optionally, an anti-rotation member can be used to partially prevent movement of the platform. Such an anti-rotation member interacts with the guide member to restrict platform movement. In one configuration, the anti-rotation member is used to prevent yaw of the platform, but allow roll or pitching motion. In use, the patient attempts to move the platform either in single or multiple directions; i.e., movement may be from front to back, vice-versa, or in side-to-side, or vice-versa, or may combine directional motions into more complex movements such as circular movement or figure eight or other patterns. As a result of the patient induced movement of the platform, the wand moves relative to the target. Rehabilitative progress can be measured with instant visual feedback by comparing the accuracy of the resultant movement with the desired movement attempted.

14 Claims, 6 Drawing Sheets

GOAL ORIENTED LEARNING DEVICE

This is a continuation of applications Ser. No. 08/019,040, filed on Feb. 18, 1993, now abandoned.

TECHNICAL FIELD OF THE INVENTION

This invention relates to an apparatus for the rehabilitation of kinesthetically impaired patients, and to a physical therapy apparatus useful in a goal oriented learning method. More specifically, disclosed and claimed herein is an apparatus for simply and easily placing in front of a patient a device which he or she may use to exercise the physical/mental neural pathway so as to markedly improve the ability of that patient to achieve a desired physical movement in response to the mental effort which is attempting to control such response, so as to overcome the patient's kinesthetic impairment. The apparatus may be advantageously used to inexpensively carry out a variety of learning methods. A primary use of the invention is for the rehabilitation of stroke victims, accident victims, and for education of patients with learning disabilities.

BACKGROUND OF THE INVENTION

Kinesthetic damage is common in stroke victims. Patients are often unable to sense or control the placement of their extremities. Hands or feet do not go where the patient wishes them to go, and to not respond as the patient wishes them to respond. Rehabilitation of such patients, so as to enable them to overcome the physical damage done to brain or nerve elements, involves relearning how to sense and direct movement through use of new neural pathways to replace those pathways which have been lost or damaged. Rehabilitation includes the use of motor program training (learning how to move the joint) and proprioception retraining (learning where the joint is). This rehabilitation process has been a long, difficult process, which is extremely frustrating for patients and their relatives and friends. In spite of the patient's best efforts, control does not return as quickly or as completely as would be desired.

THE PRIOR ART

A wide variety of methods and apparatus are known for physical therapy, and particularly for the rehabilitation of stroke victims. For the most part, apparatus currently employed, in so far as I am aware, is of two basic types. First, games are available which forces the patient to focus upon and manipulate one or more target pieces, such as is described in U.S. Pat. No. 3,721,440, issued Mar. 20, 1973 to Burns for MANUAL DEXTERITY GAME. Secondly, exercise turntables are available. Most turntables simply pivot in a circular motion, however, one particularly interesting device consists of two round plates located side by side on a board and mounted by roller bearings, each of which plates carries a rotating disc suitable for placing hands and feet thereon to manipulate discs. That device is described in German Offenlegungsschrift P 24 20 826.2-15, by Straub, published in November 1975.

Quite simply, neither of the above described devices, nor other devices of which I am aware, provides the patient with the opportunity to constantly compare physical performance with a target when exercising the lower extremities, the former device being suited for manual manipulation only, and the latter device being essentially without indicating targets against which to measure performance. With other exercise boards of which I am aware, there may exist visual neglect, visual confusion, or poor pressure and proprioception sensation in the hands or feet. Consequently, heretofore, the rate of improvement of patients attempting to improve their kinesthetic responses after damage thereto has been relatively slow. Indeed, repairing lost motor response mechanisms has been a very frustrating process both for the patient and for the physical therapy professionals who are assisting the patient.

From the foregoing, it is clear that there is a continuing need for a simple, low cost device and a quick, easily executable method for the rehabilitation of stroke and accident victims and the like. Obviously, a new device and method to dramatically improve the rate of learning in rehabilitation programs would be desirable. Further it would be particularly useful for the apparatus and method to be of the type and cost that semi-skilled or unskilled personnel, as well as patients, can confidently, accurately, and reliably carry out the rehabilitation method.

SUMMARY OF THE INVENTION

I have developed a simple goal oriented learning device for enabling stroke victims to dramatically enhance their rehabilitation or recovery rate subsequent to experiencing a stroke. The device consists of a base with non-skid feet for rather securely locating the device on a supporting surface such as a floor or a desk. The base may be provided in a pentagon or "baseball plate" type shape so as to provide clearance at the rear for locating an upwardly extending guide member with a further upwardly extending target attachment means attached thereto. A repositionable platform with a downwardly extending support point is placed on the base, at a support point receiving location, so that the platform is essentially clear of the guide member. Extending upwardly from the upper surface of the platform is a wand support means; a wand member having a wand tip at the upper end thereof is attached to the wand support means. An anti-rotation member is fixed to the wand support means; the anti-rotation member extends outwardly in a generally horizontal direction to interact with the guide member extending upwardly from the base, so as to prevent rotation of the repositionable platform. As a result, the platform may be rolled from side to side, pitched from end to end, but may not be yawed (turned in direction radially). Movement of the platform as just described may be done in single directions or simultaneously in multiple directions; i.e., movement may be from front to back, vice-versa, or in side-to-side, or vice-versa, or may combine those motions into more complex movements such as circular or figure eight or other patterns. During such movements, the wand moves relative to the downwardly suspended target. The patient can measure the accuracy of the resultant movement compared to the desired movement by observing the response of the wand relative to the target.

My invention further comprises the use of interchangeable target support rods and wands, so that that the target and wand may be relocated to a preselected height. This is desirable for the device to be used interchangeably with either the lower or upper extremities. In addition, I have provided a locating pin and a locating pin receiving means for use in positioning counterbalance weights which are desirable when using my device with a single hand (left or right) or foot (left or right).

In contrast to rehabilitation devices that have heretofore been commercially available, the novel device and method disclosed herein is adaptable to an easily transportable, low cost, reliable therapy method. The device and method is suitable for independent use by patients, thus reducing reliance upon and the cost of rehabilitation specialists. Further, the method and apparatus of the present invention allows the rehabilitation process to be removed from institutionalized health care facilitate and be placed in remote patient locations.

By way of the present invention, I have developed a novel solution to the problem of rehabilitation rate of stroke victims, and have overcome the lack of feedback or goal visualization which is inherent in the heretofore disclosed rehabilitation devices of which I am aware. The apparatus of the present invention is free of such disadvantages, due to the simplicity of the apparatus, the inclusion of a target and wand for patient feedback, due to the the ease of performing an a therapy session when utilizing the apparatus.

In short, I have developed a novel device and method for rehabilitation of anyone requiring retraining of motor function control, such as stroke victims, accident victims, or patients with certain disabling diseases. My novel device includes a unique interchangeable parts which simplifies the transition in using the device with either lower to upper extremities. In addition, my device and method accomplishes the feedback process, so essential to the rehabilitation effort, without the need for complex, expensive measurement equipment.

OBJECTS, FEATURES, AND ADVANTAGES OF THE INVENTION

It is an object of the present invention to provide a goal oriented learning device which provides patient feedback during the rehabilitation effort.

It is also an object of the present invention to provide a rehabilitation device which is simple and inexpensive to manufacture.

It is yet another object of the present invention to provide a device which is light and portable so that rehabilitation exercises as set forth by the methods described herein can be easily performed wherever desired.

It is an important feature of the present invention that immediate feedback is provided to the patient of their progress in improving their kinesthetic abilities.

It is an important and primary feature of the present invention that it is easy and simple to operate, thus reducing the need for highly trained rehabilitation personnel to be present during therapy sessions.

It is an important advantage of my invention that the rate of rehabilitation can be dramatically improved when compared to the rehabilitation rates experience by patients using conventional devices.

It is yet another important advantage that the increased rehabilitation rates may be provided at minimal cost, by use of the methods described herein.

Another related and significant advantage of my invention is that by providing feedback to the patient, it improves the attitude and the willingness of patients to undergo and continue the necessary therapy to repair damaged neural connections.

Additional objects, advantages, and novel features of the invention will be set forth in the detailed description of the invention which follows, or may become apparent to the reader from the appended claims and accompanying drawings, or may be learned by practice of the invention. The objects and advantages of the invention may be realized and attained by means of the instrumentalities and combinations particularly pointed out in the appended claims, or by their equivalents.

BRIEF DESCRIPTION OF THE DRAWINGS

My invention may be more clearly understood by reference to the accompanying drawings thereof, wherein.

DETAILED DESCRIPTION OF THE INVENTION

Figure 1A:
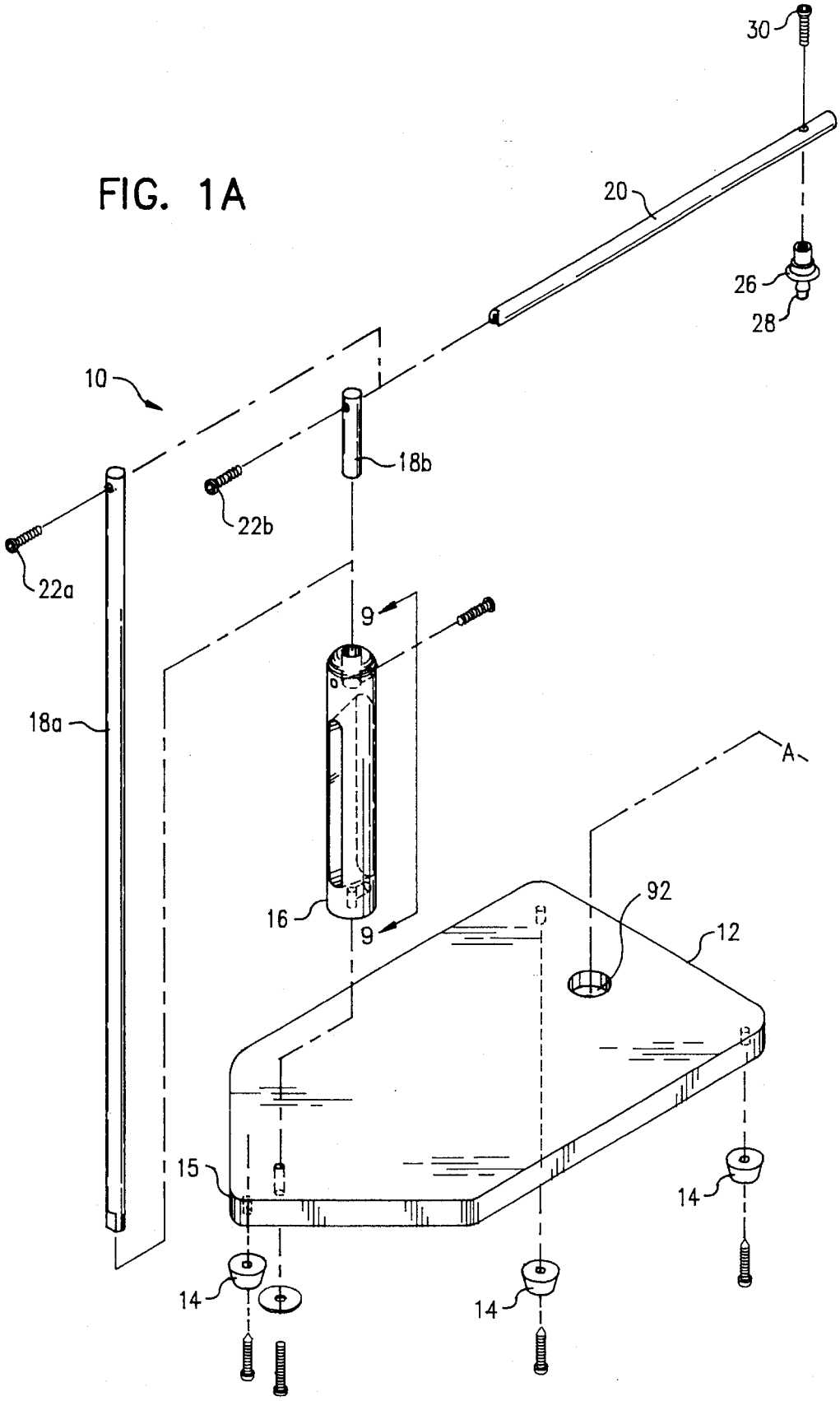
FIG. 1A is an exploded perspective view of the base of the present invention, showing the guide means and the target support means.

Referring first to FIG. 1A, base assembly 10 consists of a base 12 with non-skid feet 14 for rather securely locating the base assembly 10 on a supporting surface (not shown) such as a floor or a desk. The base 12 may be provided in a pentagon or "baseball plate" type shape so as to provide clearance at the rear 15 of the base 12 for locating an upwardly extending guide member 16. Further upwardly extending from the guide member 16, is a target support rod 18, either 18*a* (long) or 18*a* (short). A target locator rod 20 is affixed to the target support rod 18*a* or 18*b* by target locator rod attachment means 22*a* or 22*b*. At or near the distal end 24 of the target support rod 20, a target 26 having a tip end 28 is affixed. Use of target attachment means 30 is convenient, though a permanent target 26 is also possible, as well as the use of other attachment means.

Figure 1B:
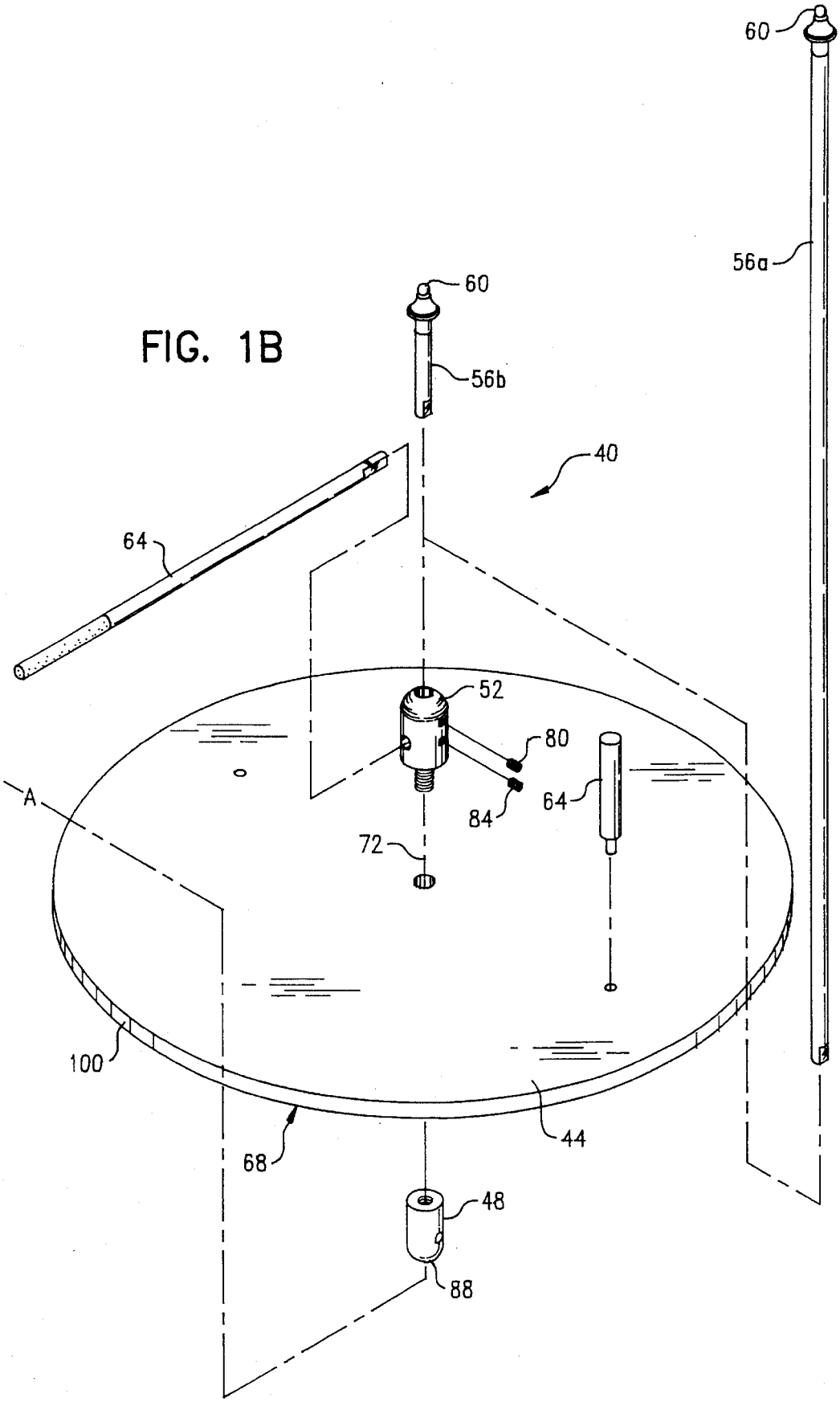
FIG. 1B is an exploded perspective of the repositionable platform, showing the point of rotation at the bottom and the interchangeable wand means at the top.

Turning now to FIG. 1B, an exploded perspective view of the platform assembly 40 is shown. The platform assembly 40 includes platform 44, pivot pin 48, wand support means 52, wand member (either 56*a* or 56*b*), a wand tip 60, and an anti-rotation means 64. Additionally, a locating pin 66 may be used for positioning counterbalance weights (see FIG. 5). Pivot pin 48 is provided at the bottom 68 and preferably centrally located 72 with respect to the platform 44. An attachment means such as a lower threaded extension 76 of wand support means 52 is provided to affix pivot pin 48 to the platform assembly 40. The wand member 56*a* or 56*b* and the anti-rotation means 64 may be secured to wand support means 52 via way of set screws 80 and 84, respectively.

Note that the pivot point 88 of pivot pin 48 sets in a pivot receiving location 92 of base 12, as indicated by connection line A—A between FIG. 1B and FIG. 1A.

Figure 1:
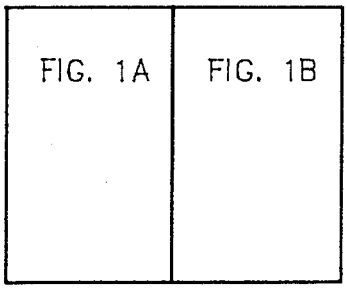
FIG. 1 is a key to the location of FIG. 1A and FIG. 1B.
Figure 2A:
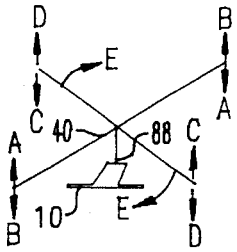
FIG. 2A is a key setting forth and identifying the direction of motion of the device as shown in FIG. 2.
Figure 2:
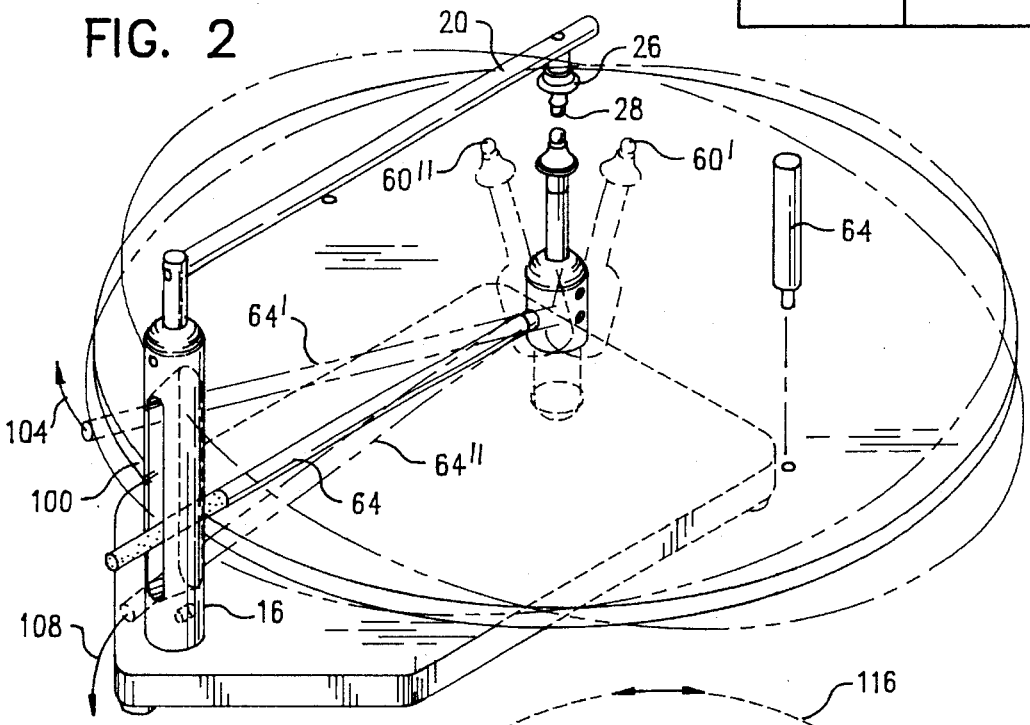
FIG. 2 is a perspective view of the various parts of the present invention, together with an optional locating pin, all assembled in working relation, and illustrating movement of the device as may occur during therapy.

Attention is now directed to FIG. 2A, where the fundamental movement of the first embodiment of my invention is illustrated, i.e., three degrees of movement of platform assembly 40 relative to the base assembly 10 is depicted. Pivot point 88 sets on base assembly 10. For convenience in visualizing the motion, consider the front 100 of the platform assembly 40 to be similar to the nose of an airplane. The platform assembly 40 can roll side to side in the direction of arrows C and C or D and D. Also, platform assembly 40 can pitch up in the direction of arrows A and A or down in the direction of B and B. However, with the anti-rotation means 64 in place as shown in FIG. 2 immediately below, the platform assembly 40 cannot experience yaw, or turn in the direction of arrow E and E, or directly opposite such direction. Thus, motion can be introduced to platform assembly 40 so that the anti-rotation rod moves up in the direction of reference arrow 104 and down in the direction of reference arrow 108, and also so that the platform assembly 40 moves from side to side. Thus the wand tip 60 may move to various locations such as 60' and 60" and the anti-rotation means 64 moves to positions 64' and 64" respectively.

Figure 3:
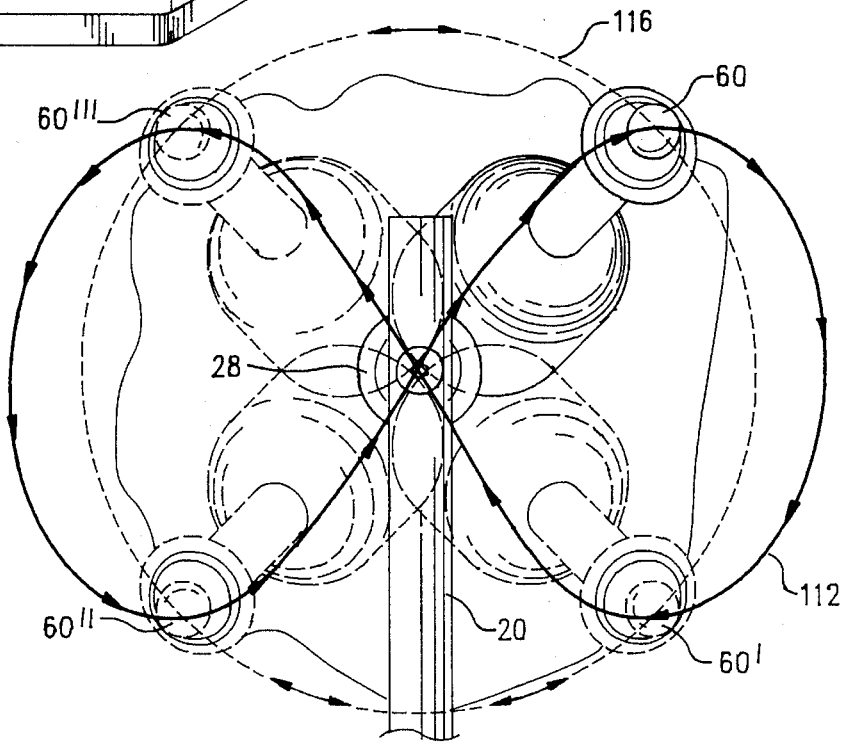
FIG. 3 is a perspective view of the movement of wand relative to the target during several different exercise methods.

Motion as just described allows the wand tip 60 to be directed in various patterns of motion relative to target tip 28. Several possible patterns are depicted in FIG. 3. In one method of use, a figure eight pattern shown by reference track 112 is used. In another method of use, a circular pattern may be used, as indicated by reference track 116. In either case, motion may run in either direction.

Figure 5:
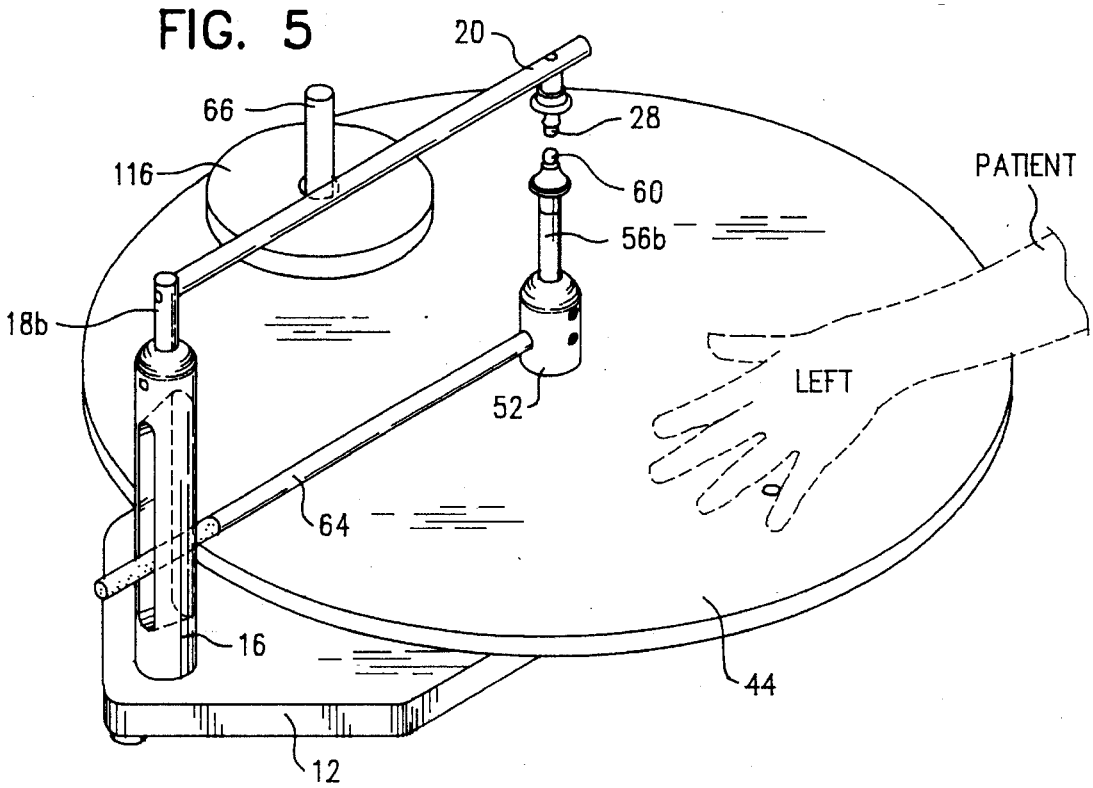
FIG. 5 is a perspective view of the various parts of the present invention, together with an optional locating pin for positioning a counterbalance weight, all assembled in working relation, and the device as set up for therapy when utilizing a single hand and utilized with the herein described anti-rotation means.
Figure 7:
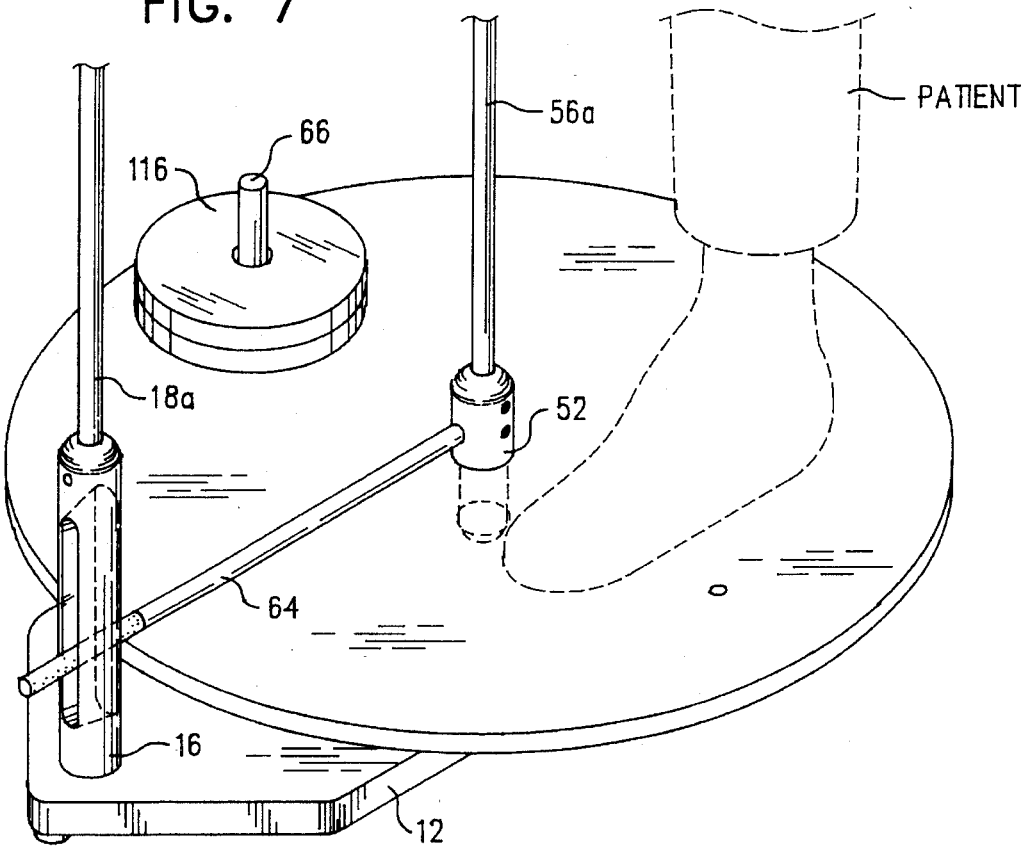
FIG. 7. is a perspective view of the second embodiment of the present invention, as set forth in FIG. 6, however, now utilizing the additional optional locating pin to secure counterbalance weights to the platform, and utilized with the herein described anti-rotation means

Attention is now directed to FIGS. 5 and 7, wherein use of the platform assembly 40 motion as just set forth is depicted. In both cases, pin 66 is used to locate counterbalance weights 116. The weights are used to offset the downward pressure of the limb being trained. It is advantageous to utilize only one limb in many cases so that the "good" limb isn't available to compensate for the limb requiring the training and rehabilitation.

Figure 4:
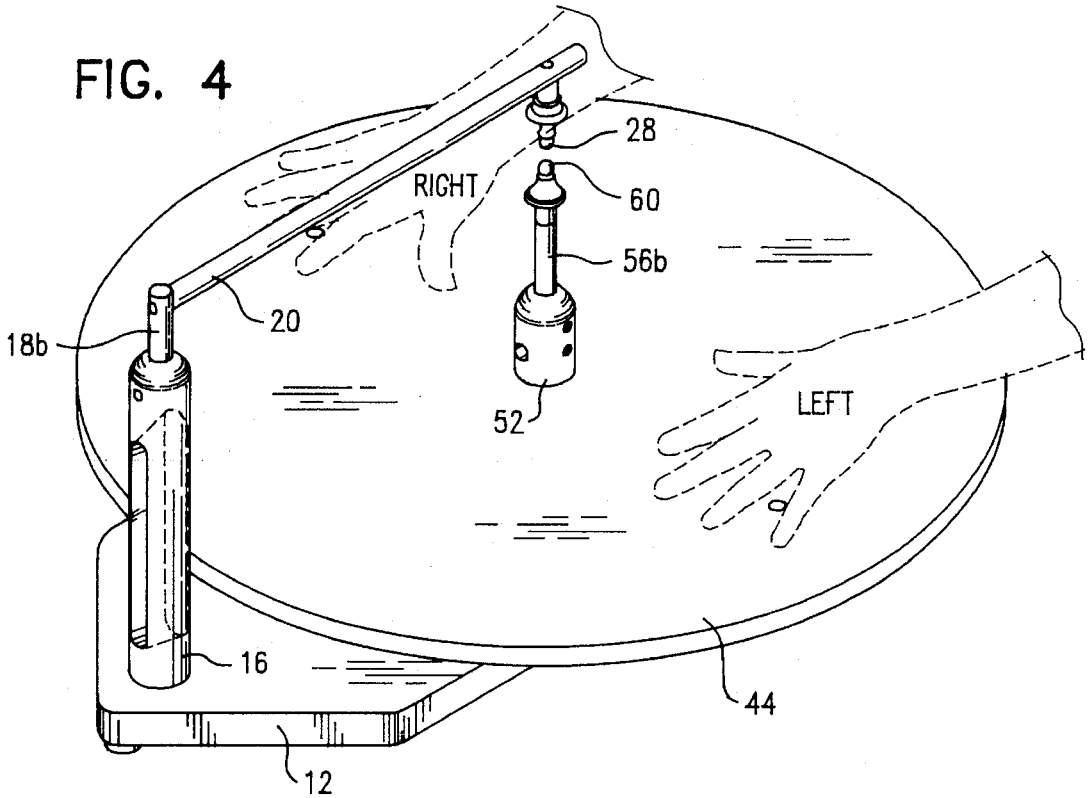
FIG. 4 is a perspective view of the various parts of the present invention, all assembled in working relation, and illustrating the device as set up for therapy when utilizing both hands for control of the device, and utilized without anti-rotation means.
Figure 6:
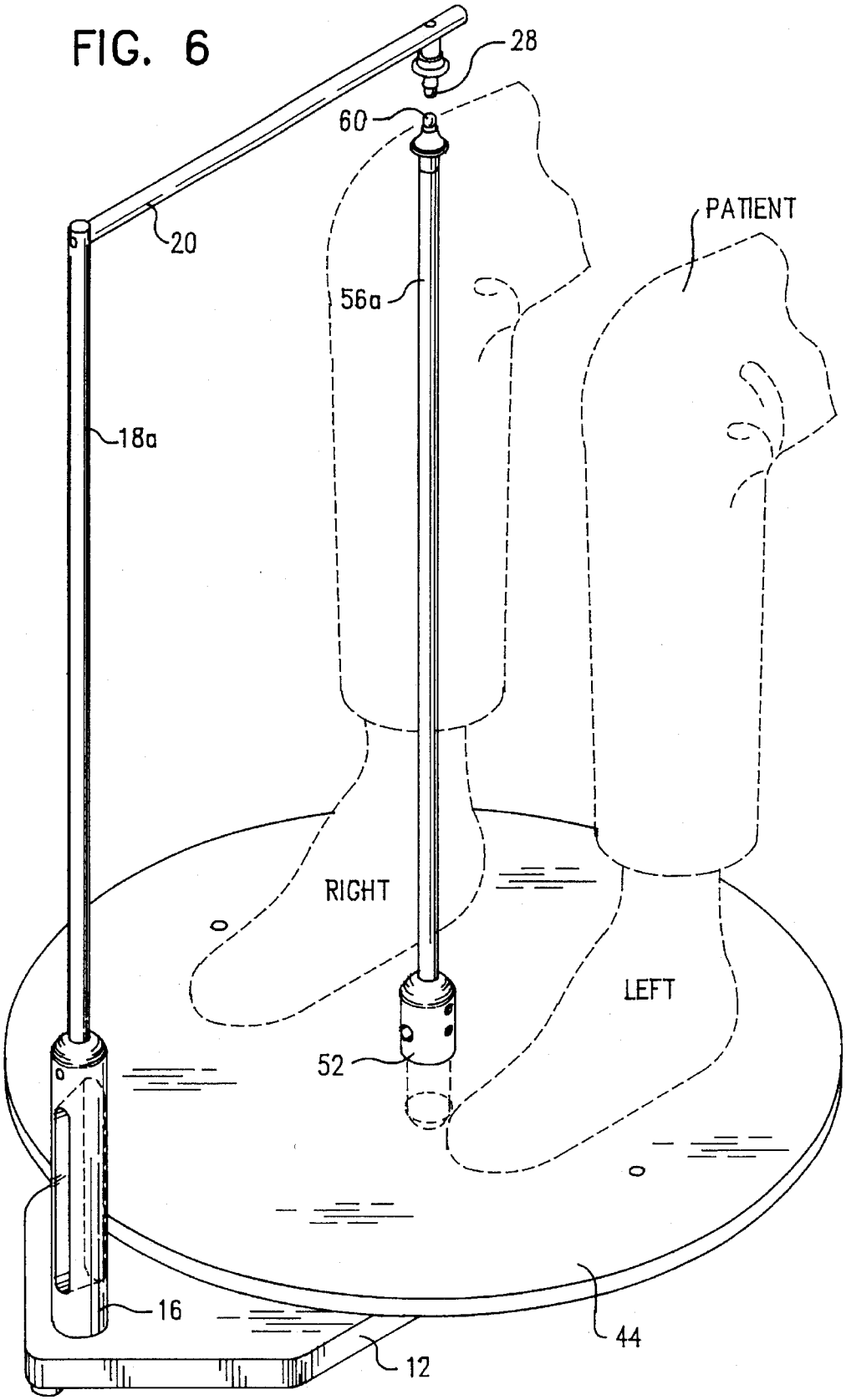
FIG. 6 is a perspective view of a second embodiment of the present invention, similar to the view first set forth in FIG. 4 above, with all parts assembled in working relation, and illustrating movement of the device as may occur during therapy when utilizing both feet for control of the device, and utilized without anti-rotation means.

Alternately, the device may be used without the anti-rotation means; such use is depicted in FIGS. 4 and 6. In those cases, the platform assembly 40 is free to turn or yaw, such as in direction E or its opposite as noted in key of FIG. 2A.

Figure 8:
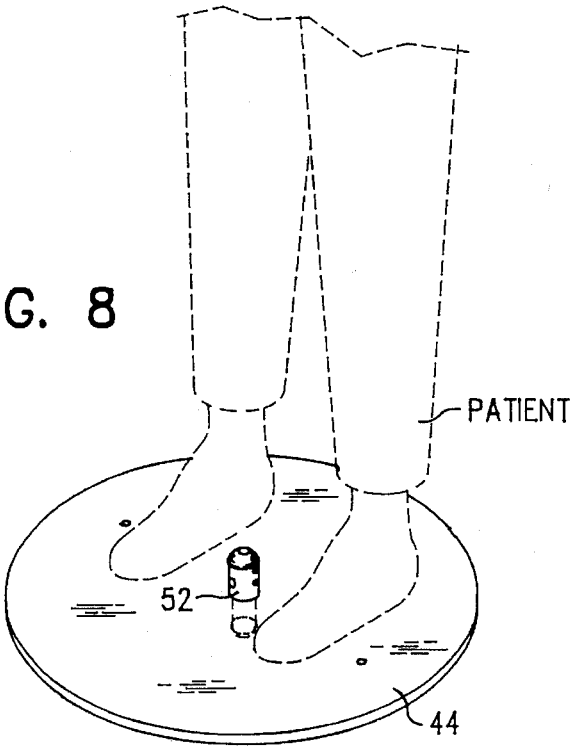
FIG. 8 is a perspective view of a third embodiment of the present invention, showing the use of the platform without the wand or target

In FIG. 8, use of the device without a wand 56*a* or 56*b* is illustrated. It may be advantageous to use the platform without feedback, to compare the results with and without visual feedback.

Figure 9:
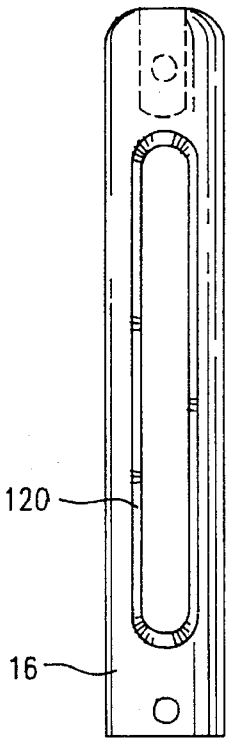
FIG. 9 is a vertical side view, taken along the line 9–7 of FIG. 1A, of the a various parts of the guide means of the present invention, showing the generally wedge shaped sidewalls forming an aperture for receiving the anti-rotation rod.

Finally, FIG. 9 sets forth a vertical side view of the guide means 16. Note the wedge shaped walls 120 which define an aperture for passage therethrough of anti-rotation rod 64.

Thus, it can be seen that I have invented a novel and advantageous rehabilitation exercise device. In one embodiment, the platform may be rolled from side to side, pitched from end to end, but may not be yawed (turned in direction radially). That movement of the platform as just described may be done in single directions or simultaneously in multiple directions; i.e., movement may be from front to back, vice-versa, or in side-to-side, or vice-versa, or may combine those motions into more complex movements such as circular or figure eight or other patterns. During such movements, a wand moves relative to the downwardly suspended target. Thus, the patient can measure the accuracy of the resultant movement compared to the desired movement by observing the response of the wand relative to the target. This visual feedback is of great assistance to users of my device.

My invention further comprises the use of interchangeable target support rods and wands, so that that the target and wand may be relocated to a preselected height. This is desirable for the device to be used interchangeably with either the lower or upper extremities. In addition, I have provided a locating pin and a locating pin receiving means for use in positioning counterbalance weights which are desirable when using my device with a single hand or foot.

To efficiently provide the present device and to utilize the present method in various environments, it can be seen that it would be advantageous to provide a variety of variations on the theme herein described. Those skilled in the art will appreciate from the foregoing description that there has herein been disclosed an exemplary rehabilitation device which permits the simple and effective goal oriented learning for repair of kinesthetic injuries. Therefore, those skilled in the art will appreciate that various modifications can be made to the exemplary device and method without departing from the spirit and scope of the invention as described herein.

Therefore, it will be understood that the foregoing description of representative embodiments of the invention have been presented only for purposes of illustration and description and for providing an understanding of the invention. It is not intended to be exhaustive or to limit the invention to the precise forms disclosed. On the contrary, the intention is to cover all modifications, equivalents, and alternatives falling within the spirit and scope of the invention as expressed in the appended claims. It is therefore intended that the scope of the invention be defined by the appended claims rather than by the foregoing description; and all changes which come within the meaning and range of equivalency of the claims are therefore intended to be embraced therein. And, of course, while the invention has herein been described and illustrated in connection with an exemplary "portable" device, the apparatus need not be "portable," but can constitute a fixed location inspection apparatus to which patients to be trained can be brought.

What is claimed is:

1. A rehabilitation training device, said device comprising:

(a) a base assembly, said base assembly comprising (i) a base, said base having an upper portion and a rear portion, (ii) a pivot support point receiving location on the upper portion of said base, (iii) an upwardly extending guide member affixed to said rear portion of said base, (iv) an upwardly extending target attachment means, said target attachment means mounted from and transverse to said guide member and extending therefrom to a location over said base, and (v) a target, said target attached to said target attachment means; and (b) a platform assembly, said platform assembly comprising (i) a platform, said platform having at least one downwardly extending pivot support point, said pivot support point adapted to being placed on and thereby received in said pivot support point receiving receiving location of said base so that said platform is repositionable in three degrees of motion about multiple axes;

(ii) a wand support means, said wand support means attached to said platform, (iii) a wand member extending upwardly from said wand support means, (iv) a wand tip extending from said wand member, whereby said wand tip extends upward from said wand member and may be repositioned with respect to said target wherein the user places at least one limb on the platform and directs the wand tip in various patterns of motion relative to the target thereby receiving visual feedback on his kinesthetic abilities.

2. The device of claim 1, wherein said platform assembly further includes an anti-rotation member, said anti-rotation member being affixed to said wand support means and extending radially outwardly therefrom so as to interact with said guide member of said base so as to tend to prevent the platform member from yaw motion, whereby said platform is substantially repositionable only in two axes, namely with respect to pitching and rolling motion.

3. A method of therapy for a patient utilizing the device of claim 1, wherein a patient repositions said platform by rolling said platform from side to side, wherein said repositioning results in movement of said wand tip, and wherein the position of said wand tip may be compared by the patient to the position of said target, so as to obtain feedback regarding the success of the repositioning effort by a patient.

4. A method of therapy for a patient utilizing the device of claim 1, wherein a patient repositions said platform by pitching said platform from end to end, wherein said repositioning results in movement of said wand tip, and wherein the position of said wand tip may be compared to the position of said target, so as to provide feedback regarding the success of a patient's repositioning effort.

5. A rehabilitation training device, said device comprising:

(a) a base assembly, said base assembly comprising (i) a base, said base having an upper portion and a rear portion, (ii) a pivot support point receiving location on the upper portion of said base, (iii) an upwardly extending guide member affixed to said rear portion of said base, (iv) an upwardly extending target attachment member, said target attachment member mounted from said guide member and comprising a portion extending outwardly from the position of said guide member to a location over said base, and (v) a target, said target attached to said outwardly extending portion of said target attachment member; and (b) a platform assembly, said platform assembly comprising (i) a platform, said platform having at least one downwardly extending pivot support portion, said pivot support portion adapted to being placed on and thereby received in said pivot support point receiving location of said base, so that the platform is repositionable in three degrees of motion about multiple axes;

(ii) a wand support portion, said wand support portion attached to said platform, (iii) a wand member extending upwardly from said wand support portion, (iv) a wand tip extending from said wand member, whereby said wand tip extends upward from said wand member and may be repositioned with respect to said target wherein the user places at least one limb on the platform and directs the wand tip in various patterns of motion relative to the target thereby receiving visual feedback on his kinesthetic abilities.

6. The device as set forth in claim 5, wherein said target attachment member comprises a target support rod and said outwardly extending portion further comprises a target locator rod, and wherein said target support rod extends upwardly from said guide member, and said target locator rod extends transversely from said target support rod, so that said target may be positioned at a point over said base.

7. The device as set forth in claim 5, wherein said outwardly extending portion of said target attachment member extends radially from said portion of said guide member to a point over said base.

8. The device as set forth in claim 5, wherein said outwardly extending portion of said target attachment member extends radially from said portion of said guide member to a point over said platform.

9. The device of claim 5, wherein said platform assembly further includes an anti-rotation member, said anti-rotation member being affixed at a first end to said wand support portion and extending radially outwardly therefrom so as to interact with said guide member of said base so as to tend to prevent the platform member from yaw motion, whereby said platform is substantially repositionable only in two axes, namely with respect to pitching and rolling motion.

10. The device as set forth in claim 5, wherein said pivot support point and said wand support portion each include interfitting attachment means whereby said pivot support point and said wand support portion may be joined at via said interfitting attachment means to secure said platform therebetween.

11. The device as set forth in claim 1 or claim 5, wherein said platform assembly further comprises a first pin attached upwardly from said platform at a location spaced radially outward from said wand support portion, said pin adapted to receive a weighting member, so that said platform may be used by a patient with application of pressure to the platform from a single limb.

12. The device as set forth in claim 6 wherein said target support rod and said wand member are each provided in a preselected height, said heights of said target support rod and said wand member is configured to be sufficiently long for movement of said wand member on said platform with respect to said target support rod by manipulation of said platform by the lower extremities of a patient while viewing said target and said wand member while a patient is in a sitting position.

13. The device as set forth in claims 2 or 7, wherein said wand support portion further comprises a laterally oriented attachment portion which defines an aperture for receipt therein of said first end of said anti-rotation rod.

14. The device as set forth in claims 2 or 7, wherein said guide member further comprises a pair of opposing wedge shaped walls which define an aperture for passage therethrough of said anti-rotation rod.

* * * * *